US006859942B1

(12) United States Patent
Cratty

(10) Patent No.: US 6,859,942 B1
(45) Date of Patent: Mar. 1, 2005

(54) PROTECTIVE PONCHO TYPE OUTER GARMENT

(76) Inventor: Steven R. Cratty, 463 Dinnerbell Rd., Butler, PA (US) 16002-7703

( * ) Notice: Subject to any disclaimer, the term of this patent is extended or adjusted under 35 U.S.C. 154(b) by 0 days.

(21) Appl. No.: 10/762,883

(22) Filed: Jan. 21, 2004

(51) Int. Cl.[7] ..... A41D 13/00
(52) U.S. Cl. ..... 2/88
(58) Field of Search ..... 2/69, 69.5, 84–89, 2/202, 209.11, 94, 114, 125; 5/482, 652, 485; 224/575, 577; 383/4

(56) References Cited

U.S. PATENT DOCUMENTS 608,351 A * 8/1898 Terramorse ..... 2/89
2,967,306 A 1/1961 Fabanich
4,316,288 A * 2/1982 Henrickson ..... 2/88
4,370,755 A * 2/1983 Crumby ..... 2/88
5,414,881 A * 5/1995 Terrazas ..... 5/417
5,452,476 A 9/1995 Jenks
5,535,449 A 7/1996 Dickey
5,564,125 A 10/1996 Waldman et al.
5,664,258 A * 9/1997 Harris ..... 2/84
5,754,982 A * 5/1998 Gainer ..... 2/2.5
5,884,331 A * 3/1999 Barajas ..... 2/69
6,708,343 B1 * 3/2004 Ceron ..... 2/88
6,735,781 B1 * 5/2004 Fulmer ..... 2/94

* cited by examiner

*Primary Examiner*—Tejash Patel
(74) *Attorney, Agent, or Firm*—Carothers & Carothers

(57) ABSTRACT

A protective poncho type outer garment to be worn about the upper body torso of a person wherein the main body panel has a shoulder portion with a neck opening for passage of a wearer's head and front and back panel portions which are open at the sides. Outwardly extending sleeves are provided for the wearer's arms and the sleeves have forearm and upper arm portions wherein the forearm portions are continuous closed tubular sleeves and the upper arm portions are open at the bottom for alternate protrusion therethrough of the wearer's arms. A first adjustable waist belt is secured to opposite sides of the front of panel portion and it is provided with a buckle fastener for securement of the first belt at the back of the wearer. Similarly a second adjustable waist belt is secured to opposite sides of the back panel portion and is also provided with a buckle fastener for securement of the second belt at the front of the wearer. This arrangement permits full adjustable wrapping of the panels about the body to accommodate heavy undergarments or backpacks and excludes the entry of fowl weather elements.

21 Claims, 2 Drawing Sheets

PROTECTIVE PONCHO TYPE OUTER GARMENT

BACKGROUND OF THE INVENTION

This invention relates generally to body garments and more particularly to protective poncho type outer garments.

It is an object of the present invention to provide a waterproof poncho type garment for hikers, backpackers, hunters, other sportsmen and stadium sport viewers which can cover a backpack yet tightly conform to the body without a backpack and provide ultimate protection and convenience of use.

SUMMARY OF THE INVENTION

The protective poncho outer garment of the present invention is designed to be worn about the upper body torso and is comprised of a main body panel having a shoulder panel portion with a neck opening for passage of the wearer's head and front and back panel portions which are fully opened at the sides. A pair of opposed outwardly extending sleeves are respectively secured to opposite sides of the shoulder portion.

A first adjustable waist belt is secured to opposite sides of the front panel portion and is provided with a buckle fastener for securement of the first belt at the back of wearer. Similarly, a second adjustable waist belt is secured to the opposite sides of the back panel portion and is also provided with a buckle fastener for securement of the second or back panel portion at the front of the wearer.

This combination permits the front and back panel portions to be readily adjusted to fit the body of the wearer with or without a backpack or with and without other undergarments, such as, heavy coats, belt packs, etc.

Another feature of the poncho style outer garment of the present invention is that the sleeves have forearm portions and upper arm portions wherein the forearm portions are provided in the form of continuous tubular closed sleeves and the upper arm portions are open at the bottom not only to provide adequate ventilation, but to also provide alternative protrusion therethrough of the wearer's arms. The outer distal ends of the tubular sleeves may be provided with elastic closures. Accordingly, the forearms and undergarment sleeves thereunder are fully protected thereabout at the distal end of the outer garment.

The upper arm portion of the sleeves, which are open underneath, also overlap the shoulder portion of the main body panel and the upper arm portions of the sleeves expand in area as they approach the shoulder portion of the garment. This provides a large overlay of the sleeves at the shoulder area so that when the front panel portion and back panel portion are adjustably secured about the body of the wearer, the side edges of the front and back panel portions are permitted to overlap at the underarm area without interfering with the open underarm exposure provided by the upper arm portions of the sleeves.

In conventional fashion, the garment may also be provided with a hood and may further provide a storage pocket on either the front or back panel portions which is dimensioned for stuffing the garment itself therein for self-storage. The garment may be made of any conventional light weight weatherproof fabric, such as, rip stop nylon.

It is preferable that the front and back panel portions of the garment are narrower in the side-to-side dimension adjacent the shoulder area so that extra protective fabric is provided at the bottom of the garment for wrapping about the body of the wearer. The narrowing of the dimensions just below the shoulder area, for example at the chest area, may be accomplished by the use of pleats.

BRIEF DESCRIPTION OF DRAWINGS

The other objects and advantages appear hereinafter in the following description and claims. The accompanying drawings show for the purpose of exemplification certain practical embodiments of the present invention without limiting the scope of the invention or appended claims, wherein:

DETAILED DESCRIPTION OF THE PREFERRED EMBODIMENT

Figure 1:
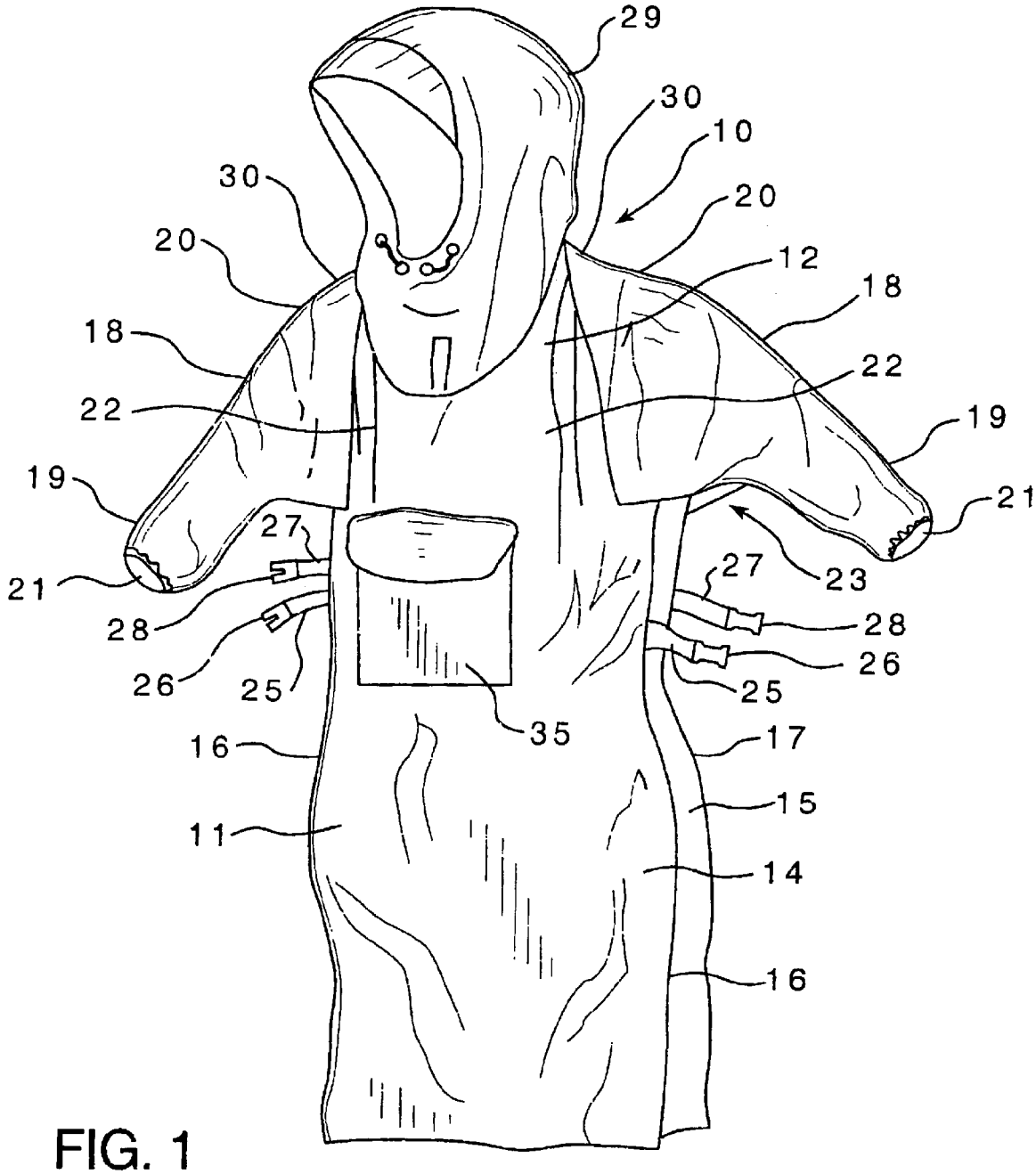
FIG. 1 is a perspective view of the protective poncho type outer garment of the present invention.
Figure 2:
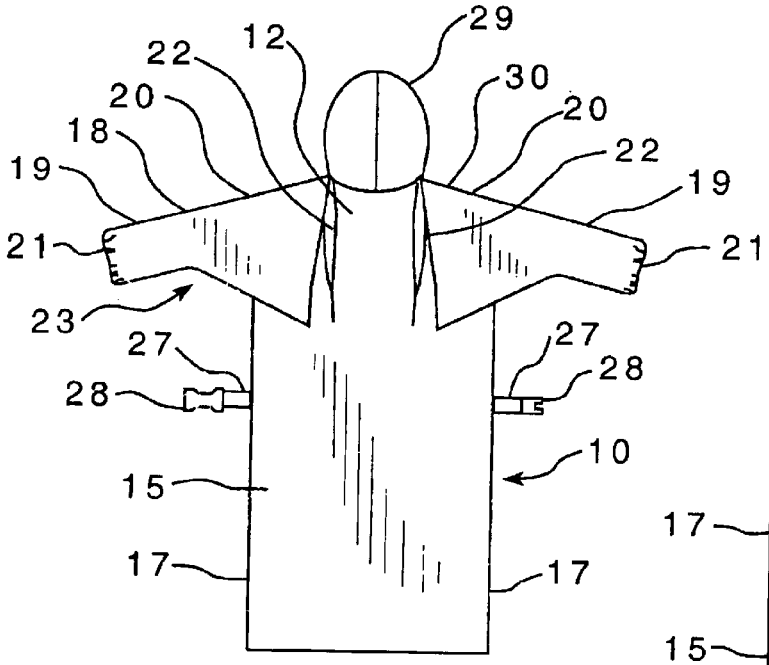
FIG. 2 is a view in back elevation of the garment shown in FIG. 1.
Figure 3:
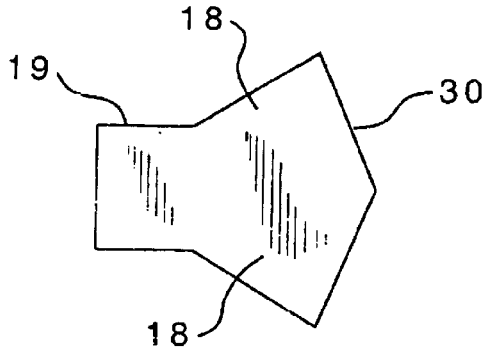
FIG. 3 is a plan view of a precut sleeve of the garment shown in FIGS. 1 and 2 prior to modification and assembly into the final product illustrated.
Figure 4:
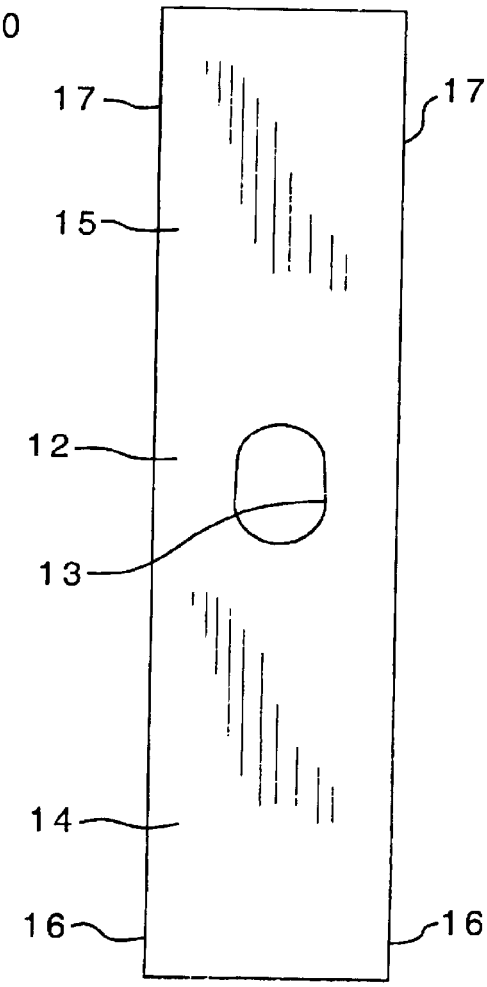
FIG. 4 is a plan view of the main body panel prior to assembly with associated parts for the protective poncho type outer garment of FIGS. 1 and 2.

Referring to the drawings, the protective poncho type outer garment 10 of the present invention is constructed of a water resistant fabric, such as rip stop nylon, and is designed to be worn about the upper body torso of a person. The garment 10 is constructed of a main body panel 11 having a shoulder panel portion 12 with a neck opening 13 (see FIG. 4) for passage of a wearer's head and a front panel portion 14 and a back panel portion 15. The front and back portions 14 and 15 are left open entirely at the sides 16 and 17 respectively to provide maximum adjustable wrapping about the wearer's body. A pair of opposed outwardly extending sleeves 18 are provided and they are respectively secured to opposite sides of the shoulder portion 12. The sleeves 18 have forearm portions 19 and upper arm portions 20. The forearm portions 19 are fully closed and are continuous tubular sleeves with elastic wrist closures 21 on the distal ends. A hood 22 is secured to the shoulder portion 12 adjacent the neck opening 13.

The front panel portion 14 and the back panel portion 15 are wider at the bottom than at the shoulder area of shoulder portion 12 so that extra material is provided at the bottom of the garment to readily and adjustably wrap around the body of the wearer and any other underlying objects such as heavy clothing or backpacks. In order to make the garment narrower in the chest area at the front and back portions to accomplish this objective, pleats 22 are provided. The upper arm portions 18 of the sleeves are open as indicated at 23 for alternate protrusion therethrough of the wearer's arms, instead of the normal insertion through the tubular forearm portions 19, and to also continuously provide adequate underarm ventilation.

A first adjustable waist belt 25 is secured to opposite sides 16 of front panel portion 14 and is provided with a buckle fastener 26 so that the wearer can secure first belt 25 with the buckle 26 at the back. This permits wrapping of the front panel portion 14 around the body of the wearer with adjustable lengthening or shortening of belt 25 to accommodate any clothing protruding underneath the front panel portion 14.

Similarly, a second adjustable waist belt 27 is secured to opposite sides 17 of back panel portion 15 and this belt is also provided with a buckle fastener 28 for securement of the second belt 27 at the front of the wearer. This permits the back panel portion 15 to be adjustably wrapped about the body of the wearer and to cover over any backpack or other objects carried on the back of the wearer and to securely wrap the back panel 15 about the wearer so that the side edges of the front panel portion 14 and the back panel portion 15 are well overlapped to prevent any ingress of fowl weather.

The proximal ends 30 of sleeves 18 expand in area at these proximal ends as illustrated in the figures to provide large overlap so that fowl weather cannot enter under the open armpit areas. This large overlap of the upper portion of the sleeves also permits the front panel portion 14 and back panel portion 15 to overlap at the sides without interfering with ventilation under the armpit areas 23 and also without interfering with the alternative possibility of the wearer protruding his or her arms through these underarm open areas at 23 instead of through the closed tubular forearm sleeve portions 19.

A storage pocket 35 is provided on the front panel portion 14 and is dimensioned for stuffing the entire garment 10 therein for self-storage.

I claim:

1. A protective poncho type outer garment to be worn about the upper body torso of a person, the garment comprising:

a main body panel having a shoulder portion with a neck opening for passage of a wearer's head and front and back portions open at the sides;

a pair of opposed outwardly extending sleeves respectively secured to opposite sides of said shoulder portion;

said sleeves having forearm and upper arm portions wherein said forearm portions are continuous tubular sleeves and said upper arm portions are open at the bottom for alternate protrusion therethrough of a wearer's arms;

a first adjustable waist belt secured to opposite sides of said front portion and having a buckle fastener for securement of said first belt at the back of a wearer:

a second adjustable waist belt secured to opposite sides of said back portion and having a buckle fastener for securement of said second belt at the front of a wearer:

said front and back portions being narrower side to side adjacent said shoulder area; and said narrower portions of said front and back portions being provided by pleats.

2. The outer garment of claim 1 including elastic distal wrist closures on said forearm portions.

3. The outer garment of claim 1 including a hood secured to said shoulder portion adjacent said neck opening.

4. The outer garment of claim 1 wherein said sleeves overlap exterior portions of said shoulder portion at their proximal ends.

5. The outer garment of claim 4 wherein said upper arm portions of said sleeves expand in area at their proximal ends.

6. The outer garment of claim 1 including a storage pocket on one of said front and back portions dimensioned for stuffing said garment therein for self-storage.

7. The outer garment of claim 1 wherein said garment is fabricated of rip stop nylon.

8. A protective poncho type outer garment to be worn about the upper body torso of a person, the garment comprising:

a main body panel having a shoulder portion with a neck opening for passage of a wearer's head and front and back portions open at the sides;

a pair of opposed outwardly extending sleeves respectively secured to opposite sides of said shoulder portion;

a first adjustable waist belt secured to opposite sides of said front portion and having a buckle fastener for securement of said first belt at the back of a wearer;

a second adjustable waist belt secured to opposite sides of said back portion and having a buckle fastener for securement of said second belt at the front of a wearer;

said front and back portions being narrower side to side adjacent said shoulder portion; and said narrower portions of said front and back portions being provided by pleats.

9. The outer garment of claim 8, said sleeves having forearm and upper arm portions wherein said forearm portions are continuous tubular sleeves and said upper arm portions are open at the bottom for alternate protrusion therethrough of a wearer's arms.

10. The outer garment of claim 9 including elastic distal wrist closures on said forearm portions.

11. The outer garment of claim 8 wherein said sleeves overlap exterior portions of said shoulder portion at their proximal ends.

12. The outer garment of claim 11 wherein said upper arm portions of said sleeves expand in area at their proximal ends.

13. The outer garment of claim 8 including a hood secured to said shoulder portion adjacent said neck opening.

14. The outer garment of claim 8 including a storage pocket on one of said front and back portions dimensioned for stuffing said garment therein for self-storage.

15. The outer garment of claim 8 wherein said garment is fabricated of rip stop nylon.

16. A protective poncho type outer garment to be worn about the upper body torso of a person, the garment comprising:

a main body panel having a shoulder portion with a neck opening for passage of a wearer's head and front and back portions open at the sides;

a pair of opposed outwardly extending sleeves respectively secured to opposite sides of said shoulder portion;

said sleeves having forearm and upper arm portions wherein said forearm portions are continuous tubular sleeves and said upper arm portions are open along the bottom for alternate protrusion therethrough of wearer's arms; and said upper arm portions secured at their proximal ends to exterior portions of said shoulder and front and back portions.

17. The outer garment of claim 16 wherein said upper arm portions of said sleeves expand in area at their proximal ends.

18. The outer garment of claim 16 including a first adjustable waist belt secured to opposite sides of said front portion and having a buckle fastener for securement of said first belt at the back of a wearer.

19. The outer garment of claim 18 including a second adjustable waist belt secured to opposite sides of said back portion and having a buckle fastener for securement of said second belt at the front of a wearer.

20. The outer garment of claim 19 wherein said front and back portions are narrower side to side adjacent said shoulder area.

21. The outer garment of claim 20 wherein said narrower portions of said front and back portions are provided by pleats.

* * * * *